US010920442B2

(12) United States Patent
Pezzola et al.

(10) Patent No.: US 10,920,442 B2
(45) Date of Patent: Feb. 16, 2021

(54) EXPEDIENT RETROFIT FOR EXISTING BUILDINGS

(71) Applicant: United States of America as Represented by The Secretary of The Army, Alexandria, VA (US)

(72) Inventors: Genevieve L Pezzola, Vicksburg, MS (US); Catherine S Stephens, Clinton, MS (US); Omar Esquilin-Mangual, Vicksburg, MS (US); Andrew B Edwards, Toney, AL (US)

(73) Assignee: UNITED STATES of AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 16/296,109

(22) Filed: Mar. 7, 2019

(65) Prior Publication Data

US 2020/0284061 A1 Sep. 10, 2020

(51) Int. Cl.

| | |
|---|---|
| ***E04H 9/06*** | (2006.01) |
| ***E04G 23/04*** | (2006.01) |
| ***F41H 5/24*** | (2006.01) |

(52) U.S. Cl.

CPC ..... *E04H 9/06* (2013.01); *E04G 23/04* (2013.01); *F41H 5/24* (2013.01)

(58) Field of Classification Search

CPC .... E04H 9/04; E04H 9/06; E04H 9/10; E04G 23/04; E04G 25/04; E04G 25/02; E04G 1/20; E04G 11/02; E04G 11/04; E04G 11/082; E04G 25/065; E04G 25/061; F41H 5/24; F41H 5/013; F41H 5/26

See application file for complete search history.

(56) References Cited

U.S. PATENT DOCUMENTS

| | | | | | |
|---|---|---|---|---|---|
| 1,551,635 | A * | 9/1925 | Birch | E04G 25/04 | 254/104 |
| 1,719,528 | A * | 7/1929 | Beckley | E04G 25/04 | 248/357 |
| 3,409,266 | A * | 11/1968 | Jennings | E04G 25/02 | 249/18 |
| 3,807,681 | A * | 4/1974 | Kane | E04G 9/08 | 249/29 |
| 3,822,850 | A * | 7/1974 | Elias | E04G 21/3233 | 248/551 |
| 4,122,645 | A * | 10/1978 | Tooley | E04G 11/486 | 52/651.1 |
| 5,292,098 | A * | 3/1994 | Worthington | E04G 25/02 | 248/354.1 |
| 5,765,248 | A * | 6/1998 | Ono | E04H 12/185 | 14/75 |

(Continued)

*Primary Examiner* — Theodore V Adamos
(74) *Attorney, Agent, or Firm* — Brian C. Jones

(57) ABSTRACT

A configuration, all components of which are man portable in some embodiments, for holding panels to protect assets against external force and impacts from airborne projectiles. An open box-like stackable frame module holds panels along a side of the frame. Multiple frames are connected to construct a protective barrier, such as a wall. Frames include provisions for connection in a vertical configuration so as to allow stacking of the frames to increase the height of the barrier. A method of installing is also provided.

7 Claims, 16 Drawing Sheets

(56) References Cited

U.S. PATENT DOCUMENTS

| | | | | |
|---|---|---|---|---|
| 6,722,471 | B2 * | 4/2004 | Wolfe | E04G 5/10 182/178.5 |
| 10,024,069 | B2 * | 7/2018 | Bond | E04G 11/483 |
| 2003/0190197 | A1 * | 10/2003 | Lanka | E04G 23/04 405/272 |
| 2010/0005735 | A1 * | 1/2010 | Gillespie | E04G 25/04 52/126.6 |
| 2011/0000514 | A1 * | 1/2011 | Boone | E04B 1/3441 135/123 |
| 2012/0011993 | A1 * | 1/2012 | Malone | F41H 5/013 89/36.02 |
| 2013/0043053 | A1 * | 2/2013 | Malorni | B25B 13/50 173/216 |
| 2014/0130438 | A1 * | 5/2014 | Durst | E04B 1/18 52/638 |
| 2017/0275994 | A1 * | 9/2017 | Moye | E04G 25/04 |
| 2018/0258657 | A1 * | 9/2018 | Chevis | E04G 25/04 |

* cited by examiner

EXPEDIENT RETROFIT FOR EXISTING BUILDINGS

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to protective structures and, more particularly but not exclusively, to rapid assembly protective walls that can be used in existing buildings.

Description of the Related Art

This section introduces aspects that may help facilitate a better understanding of the invention. Accordingly, the statements of this section are to be read in this light and are not to be understood as admissions about what is prior art or what is not prior art.

To protect personnel and assets, organizations such as the military use a variety of protective materials ranging from soil cover to expensive, high-performance, lightweight ballistic ceramics. For the military, a need exists for an inexpensive blast and fragmentation barrier for large-area applications, such as forward facilities, installation and structure perimeters, and both interior and exterior protective upgrades. Certain applications call for panels that may be emplaced on robust platforms, both the modular platform sections and panels being of sufficiently light weight to be man portable. Needs for physical protection exist in the commercial, first responder and consumer communities also, but on a different scale. For example, there is a need for a structure to hold inexpensive protective cladding with superior resistance to wind damage, including penetration of debris generated by natural forces, such as tornadoes and hurricanes. Currently known barriers are described in U.S. Pat. No. 8,464,493 issued Jun. 18, 2013 "Transportable Modular Configuration For Holding Panels", and in U.S. patent application Ser. No. 12/920,497 filed Mar. 2, 2009 "Transportable Modular System Permitting Isolation of Assets". The content of each of the above filings is incorporated herein by reference.

Although currently available protection systems provide valuable protection in many instances, still further improvements are desirable. Embodiments of the present invention provide solutions to at least some of these outstanding needs.

SUMMARY

The present invention was developed to address the challenges described in the Background section. Additional research and further development has led to a novel approach to provide improved protective barriers for use within the interior of existing buildings.

It is important to protect both material and personnel from catastrophe, especially in cases where the probability of occurrence is greater than the norm. Conventionally, both temporary and permanent means may be used for this purpose, depending on the scenario. For example, a permanent military facility may best be protected by a permanent configuration, whereas a mobile field unit would best be served by a temporary, but not necessarily less effective, configuration. Conventionally, protection against manmade catastrophe, such as occurs in war zones, has been provided with large bulky concrete structures or earthen embankments that require heavy equipment to produce, whether temporary or permanent. Common needs for protective structure may include barriers to prevent personnel access, vehicular intrusion, or even line-of-site access, as well as protective enclosures for emergency response personnel or revetments for high value assets. Select embodiments of the present invention provide good protection for both personnel and valued assets and are of value for the protection of military, industrial, community and personal assets. Embodiments of the present invention also can be implemented quickly and efficiently in an urban environment without requiring heavy equipment.

The structures and methods for Expedient Retrofit for Existing Building (EREB) disclosed herein provide improved levels of protection over that which is provided by an existing building from small arms, fragmenting rounds, improvised explosives, and blast threats. EREB can include a frame, compression members, and armor panels to construct the retrofit on the interior of the building. No anchoring or special tools are required.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Figure 1:
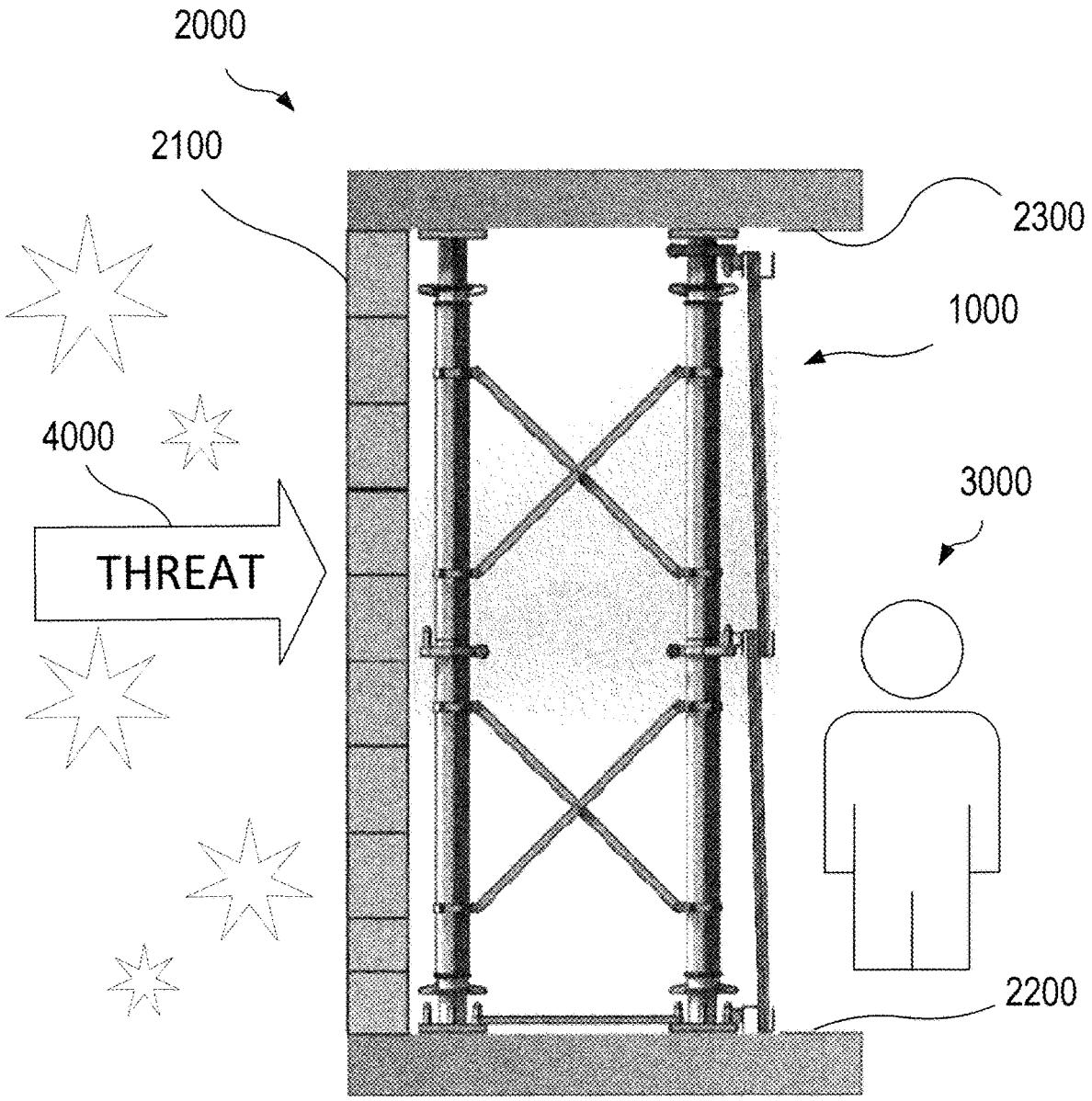
FIG. 1 depicts aspects of an exemplary platform assembly as installed within a room of a building, according to certain embodiments of the invention.

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

The Expedient Retrofit for Existing Buildings (EREB) System is a modular, light weight ballistic and blast wall retrofit. EREB is rapidly deployable and recoverable. No anchoring, tools, or equipment are required for setup or operation. EREB is modular for any room width and a range of room heights. The system can be tailored based off of the threat and existing building wall properties. In some embodiments, every component is less than 60 pounds and can be installed quickly. This system can be employed in urban environments where space is valuable, as it only takes up 42.5" in depth, in select embodiments, with the possibility of decreasing that depth in other embodiments. Select embodiments of the present invention comprise transportable components for fortifying an area. Select embodiments of the present invention include box-shaped platform modules for holding panels in order to provide a secure barrier. The panels may be resistant to sudden impulses such as may occur with explosions or impact with projectiles and also may shield what they are protecting from view of possible adversaries.

Embodiments of the present invention provide modular blast and ballistic retrofit (interior) solutions for existing buildings, and hence can be used in urban environments. Advantageously, the platform assemblies disclosed herein are well suited for use across a wide range of different building and room configurations, and can be used in spaces having various height, width, and/or depth dimensions. The protective panels and other elements of the platform assembly provide protection against a wide variety of threats, and the platform assemblies can employ protective armor panels of varying thickness and material composition. The platform assemblies can be used on any floor of a building, and they are easy to construct in an efficient matter. The platform assemblies provide enhanced performance for stopping or reducing fragmentation and penetration into the room, and can operate as a debris catcher for primary and secondary fragmentation caused by blast. The platform assembly EREB systems can also be deployed for complicated scenarios to add more protection if desired and/or necessary. For example, if it is desired, a textile fabric or other type of material can be added to the interior of the exterior wall of the existing building to act as the preliminary catcher system, and the EREB system can serve to hold that material in place, as well as the protective armor panels. Additionally, a metal wire mesh can be attached to the top portion of the pressure poles of the EREB system, above where the protective armor panels extend, to serve as a debris catcher above where the panels reach. According to some embodiments, the upper and lower end legs (e.g. top units and base units) can be extended or retracted to reach any height in between 8' and 10.5' (common floor heights). Additional tubular pieces can be added to reach 14'. In exemplary embodiments, the platform assembly does not require a large number of uniquely designed pieces, and hence is easy to install. In some cases, the large components are constructed of aluminum or another lightweight material, thus making the assembly easy to install. In some cases, the largest components are less than 4' long, making them easy to transport in complicated building layouts and stairs. The pressure poles (e.g. base unit and top unit) make contact with the floor and ceiling for a variety of heights and can be tightened to a specific "jacking pressure", for example by adjusting the locking nuts (e.g. rotating them about the threaded posts of the base and top units). This compression can operate to create additional friction to catch or halt debris from a blast. The pressure poles (e.g. base and top units in combination with intermediate and upper posts) may also provide additional support to the structure above the installment, in the case of load-bearing wall failure. In exemplary embodiments, a platform assembly has a footprint that is less than 43" in depth. In some cases, armored protective panels can be tailored by need (e.g. exemplary z-bar embodiments provide room for 1.5" of protective paneling).

Turning now to the drawings, FIG. 1 depicts an exemplary platform assembly 1000 according to embodiments of the present invention. As shown here, platform assembly 1000 is installed within a building 2000, such that the platform assembly 1000 is positioned adjacent to an exterior wall 2100 of the building 2000, and extends between a floor 2200 of the building and a ceiling 2300 of the building. The platform assembly 1000 can operate to protect an occupant 3000 residing within the building when a blast event or other threat 4000 occurs on the outside of the building. For example, as a result of a blast or other threat, fragments of the wall 2100 may be projected toward the occupant, however the platform assembly prevents the fragments from reaching the occupant. Protective panels can operate to catch fragments, debris, pieces of masonry from the broken wall, bullets, and the like, that are projected into the room, thereby protecting the room occupants.

Figure 2:
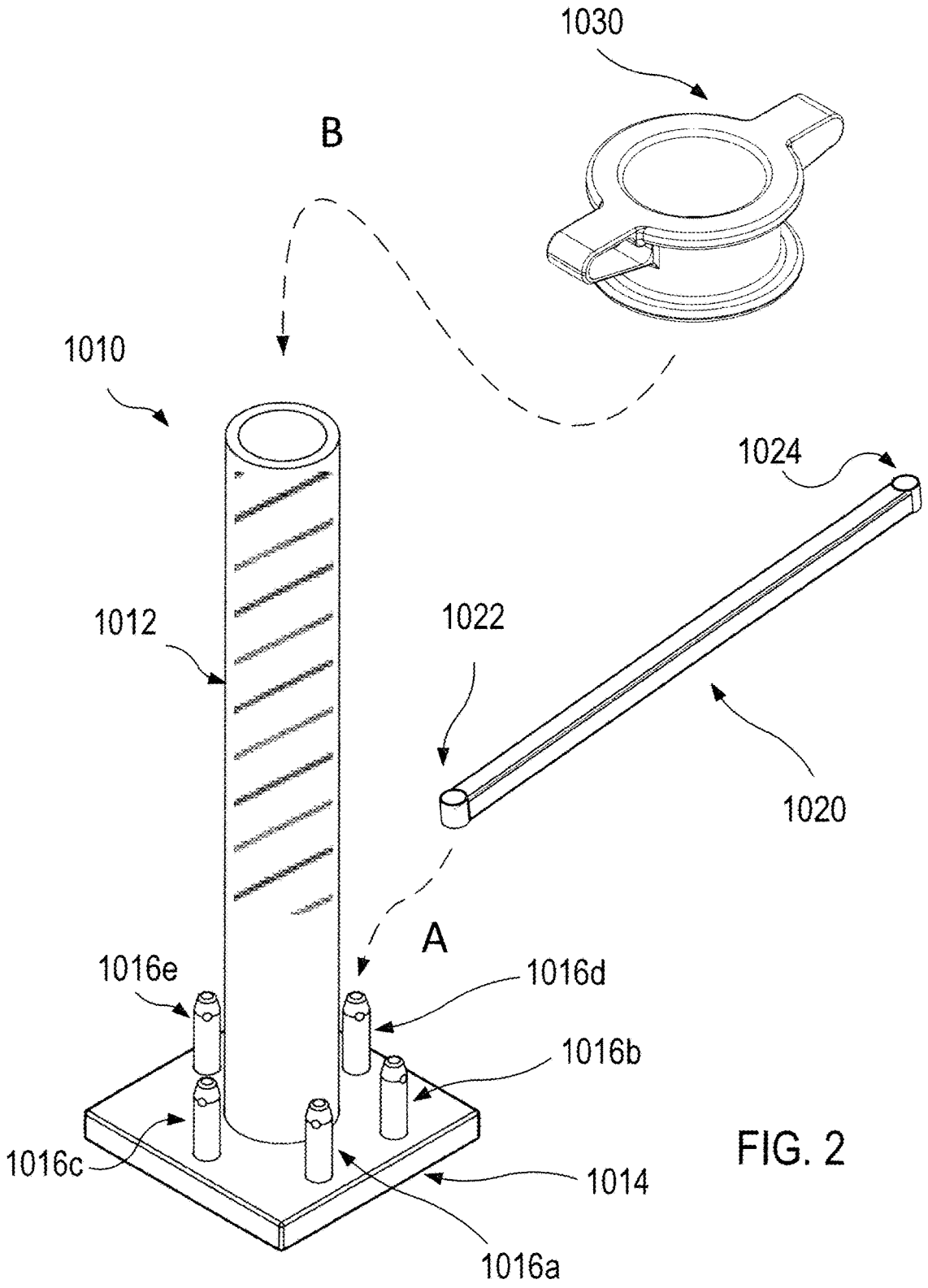
FIG. 2 illustrates components of an exemplary platform assembly, according to certain embodiments of the invention.

FIG. 2 illustrates the assembly of various components of an exemplary platform assembly. According to some embodiments, a platform assembly can include a base unit 1010 having a threaded post 1012, a plate 1014, a first exterior pin 1016*a*, a second exterior pin 1016*b*, a first lateral pin 1016*c*, a second lateral pin 1016*d*, and an interior pin 1016*e*. When a platform assembly is installed in a building, the plate of the base unit may not be bolted to the floor. A platform assembly can also include an exterior stability bar 1020 having a first sleeve 1022 and a second sleeve 1024. The sleeves can be configured to slidingly receive pins of a base unit. For example, the first sleeve 1022 can be configured to slidingly engage a second lateral pin 1016*d* of the base unit, as indicated by arrow A, and the second sleeve 1024 can be configured to slidingly engage a first lateral pin of another base unit (not shown in this figure). Further, a platform assembly can include a lower locking nut 1030 having a threaded interior section (not shown), which can threadingly engage the threaded post 1012 of the base unit 1010, when locking nut 1030 receives threaded post 1012 as indicated by arrow B.

Figure 3:
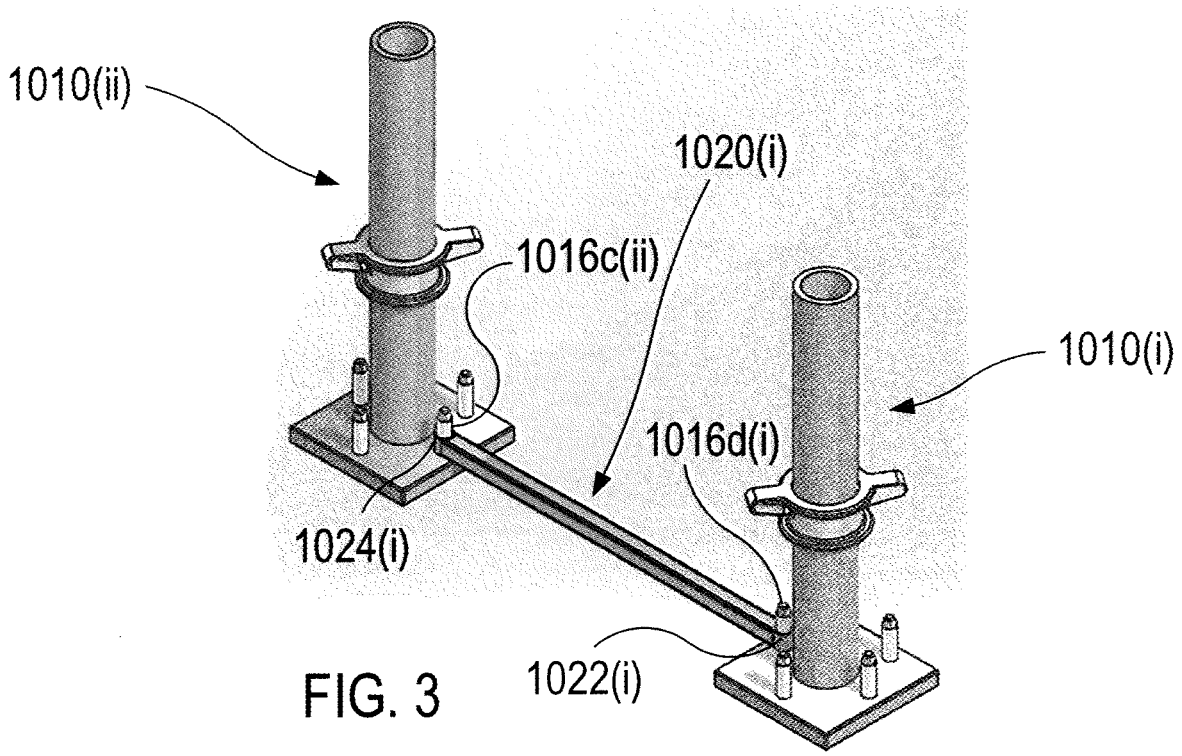
FIGS. 3 and 4 depict components of a partially assembled platform assembly, according to certain embodiments of the invention.

As illustrated in FIG. 3, a first exterior base unit 1010(*i*) can be coupled with a second exterior base unit 1010(*ii*) via an exterior stability bar 1020(*i*). A first sleeve 1022(*i*) of the exterior stability bar 1020(*i*) receives a second lateral pin 1016*d*(i) of the first exterior base unit and a second sleeve 1024(*i*) of the exterior stability bar 1020(*i*) receives a first lateral pin 1016*c*(ii) of the second exterior base unit 1010(*ii*).

Figure 4:
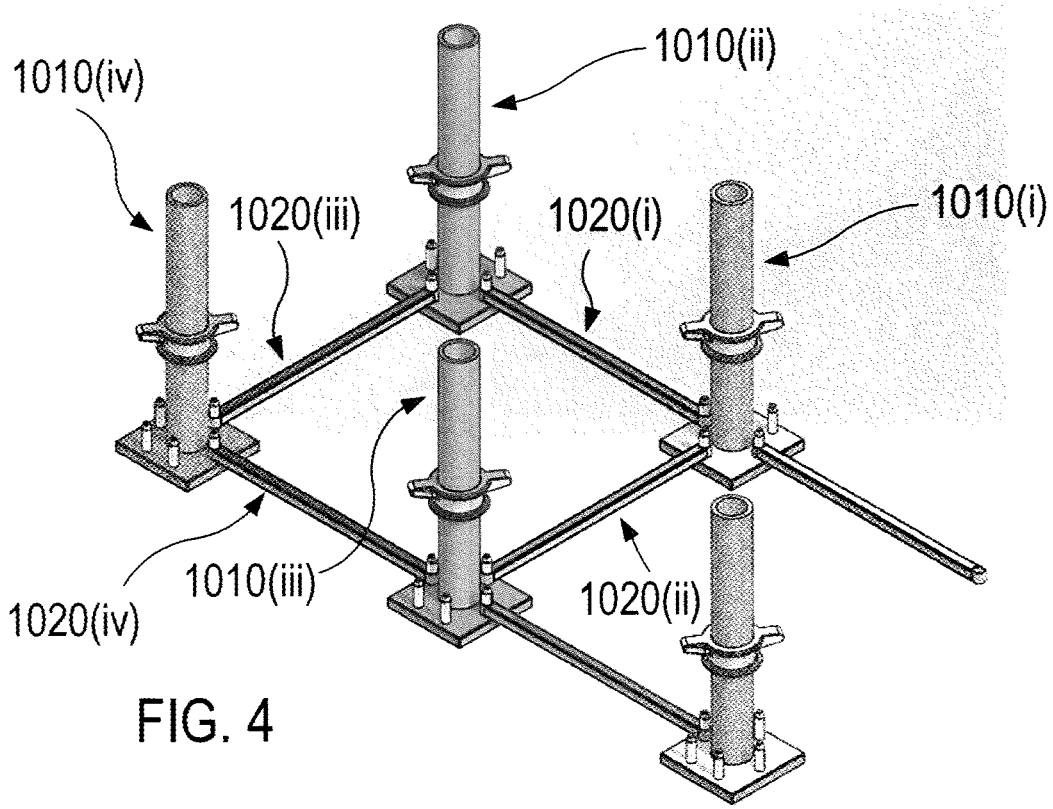

As illustrated in FIG. 4, a first exterior base unit 1010(*i*) can be coupled with a second exterior base unit 1010(*ii*) via an exterior stability bar 1020(*i*) and can also be coupled with a first interior base unit 1010(*iii*) via a first lateral stability bar 1020(*ii*). Likewise, a second interior base unit 1020(*iv*) can be coupled with the second exterior base unit 1010(*ii*) via a second lateral stability bar 1020(*iii*) and can also be coupled with the first interior base unit 1010(*iii*) via an interior stability bar 1020(*iv*).

As shown in FIGS. 3 and 4, the stability bars can operate as spacers between base units. In some embodiments, the stability bars have a predetermined length, such that a platform assembly can be put together without having to measure the distance between adjacent base units. This feature can greatly enhance the ease and speed in which the platform assemblies can be assembled. In some cases, the predetermined length is selected so that four base units are positioned at four corners of a square shape. By using stability bars of uniform length, it is possible to quickly construct an extended platform assembly that runs along the length of a wall in a straight line. In FIGS. 3 and 4, the first exterior pins of first exterior base unit 1010(*i*) and second exterior base unit 1010(*ii*) are visible, whereas the second exterior pins are not visible (hidden behind the threaded posts, in these views). First and second exterior pins of first interior base unit 1010(*iii*) and second interior base unit 1020(*iv*) are visible. When constructing the platform assembly, an individual can easily and quickly position the base units at their respective locations, and in their respective orientations, by facing the exterior pins of the interior base units toward the existing building wall, and by facing the exterior pins of the exterior base units away from the existing building wall.

Figure 5:
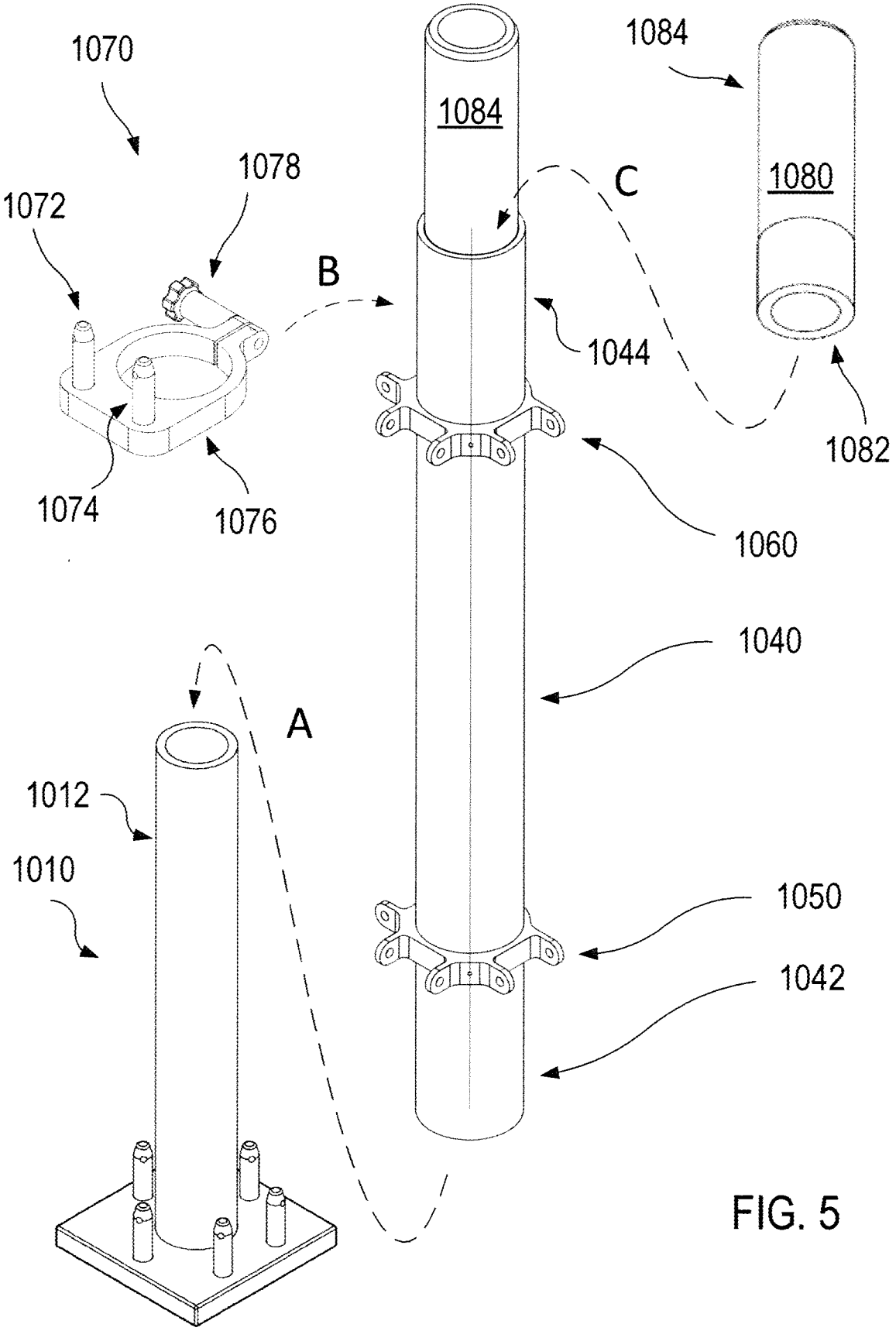
FIG. 5 illustrates components of an exemplary platform assembly, according to certain embodiments of the invention.

FIG. 5 illustrates the assembly of various components of an exemplary platform assembly. According to some embodiments, a platform assembly can further include an intermediate post 1040 having a first (or lower) mount 1050 and a second (or upper) mount 1060, a lower support 1070, and a connector post 1080. Intermediate post 1040 also includes a lower portion 1042 and an upper portion 1044. Connector post 1080 includes a lower portion 1082 and an upper portion 1084. As shown here, lower support 1070 includes a first pin 1072, a second pin 1074, a collar 1076 defining an aperture, and an adjustment mechanism 1078 (e.g. threaded bolt to engage a corresponding threaded interior cylinder of the collar). The lower portion 1042 of the intermediate post 1040 is configured to receive the threaded post 1012 of the base unit 1010, as indicated by arrow A. Although a locking nut is not shown here, a locking nut coupled with the threaded post 1012 can operate to support the intermediate post 1040. The aperture of collar 1076 of the lower support 1070 is configured to receive the upper portion 1044 of the intermediate post 1040, as indicated by arrow B. The lower support 1070 can be clamped to the intermediate post 1040 by tightening the adjustment mechanism 1078. The lower portion 1082 of connector post 1080 is configured to be received by the upper portion 1044 of the intermediate post 1044, as indicated by arrow C.

Figure 6:
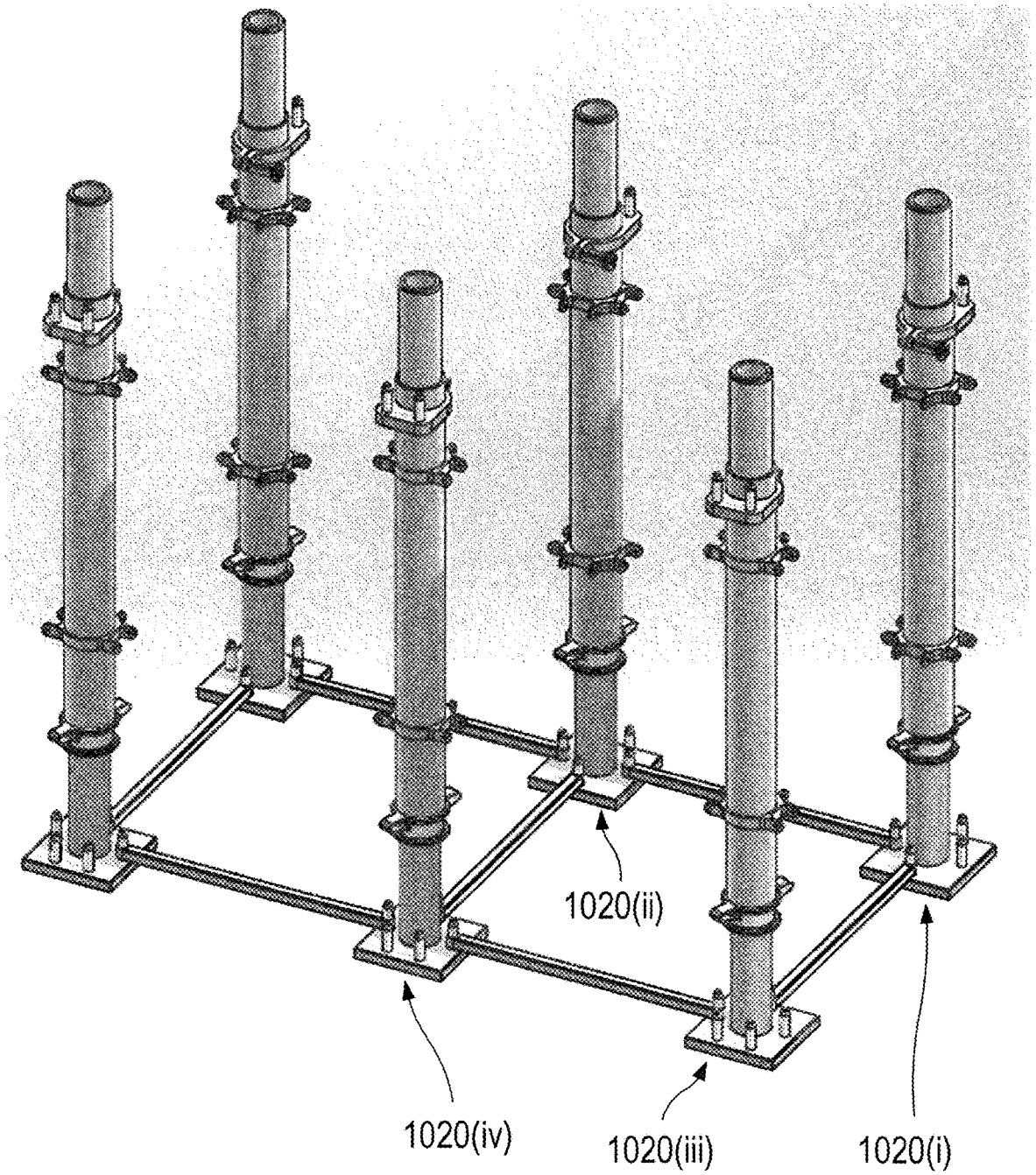
FIG. 6 depicts components of a partially assembled platform assembly, according to certain embodiments of the invention.

FIG. 6 depicts a partially assembled platform assembly. As shown here, the assembly includes a first exterior base unit 1020(*i*) with attached components as further described herein with regard to FIGS. 2-5, a second exterior base unit 1020(*ii*), a first interior base unit 1020(*ii*), and a second interior base unit 1020(*iv*). As illustrated here, additional base units and corresponding component parts can also be added so as to form an extended platform assembly.

Figure 7:
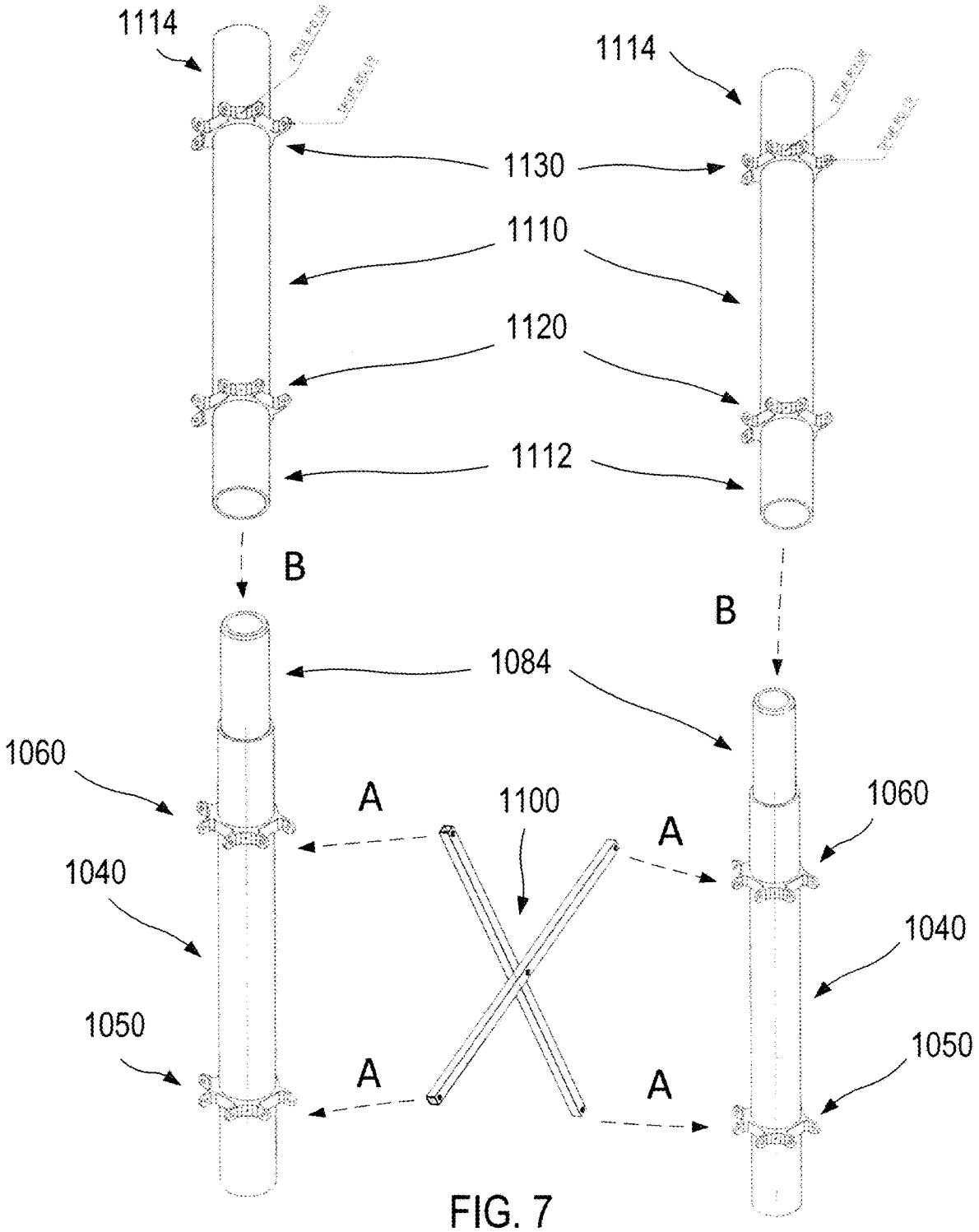
FIG. 7 illustrates components of an exemplary platform assembly, according to certain embodiments of the invention.

FIG. 7 illustrates the assembly of various components of an exemplary platform assembly. According to some embodiments, a platform assembly can further include multiple upper posts 1110, where an individual upper post 1110 includes a lower portion 1112, an upper portion 1114, a first (or lower) mount 1120, and a second (or upper) mount 1130. As shown here, a platform assembly can also include a cross-member 1100, which can be attached to the first mounts 1050 and second mounts 1060 of the intermediate posts 1040, as shown by arrows A. Although not shown here, an additional cross-member can be attached to the first mounts 1120 and the second mounts 1130 of the upper posts 1110. The lower portion 1112 of an upper post 1110 can be configured to receive an upper portion 1084 of a connector post, as shown by arrows B.

Figure 8:
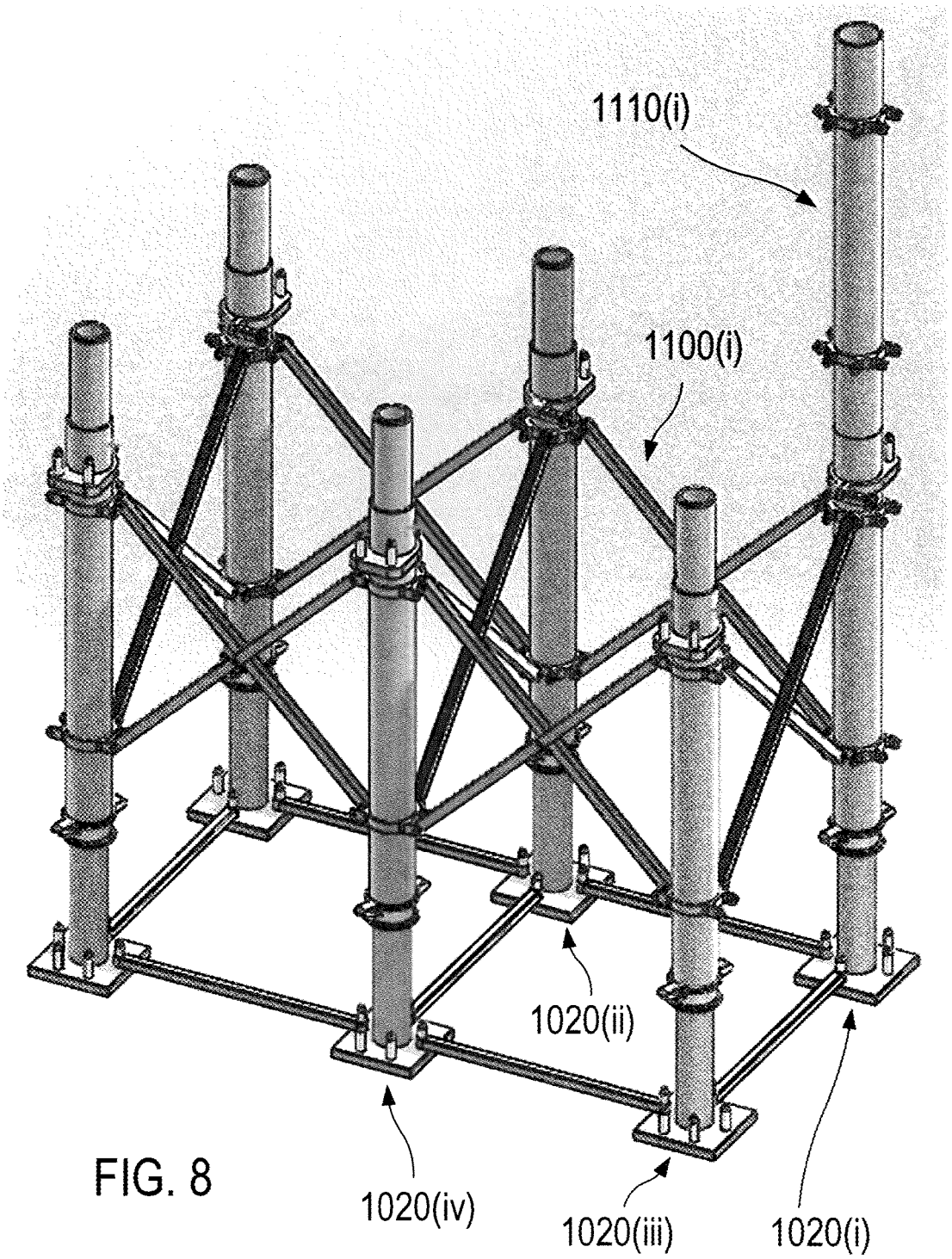
FIG. 8 depicts components of a partially assembled platform assembly, according to certain embodiments of the invention.

FIG. 8 depicts a partially assembled platform assembly. As shown here, the assembly includes a first exterior base unit 1020(*i*) with attached components as further described herein with regard to FIGS. 2-7 (e.g. first exterior upper post 1110(*i*) and first exterior cross-member 1100(*i*)), a second exterior base unit 1020(*ii*), a first interior base unit 1020(*ii*), and a second interior base unit 1020(*iv*). As illustrated here, additional base units and corresponding component parts can also be added so as to form an extended platform assembly.

Figure 9:
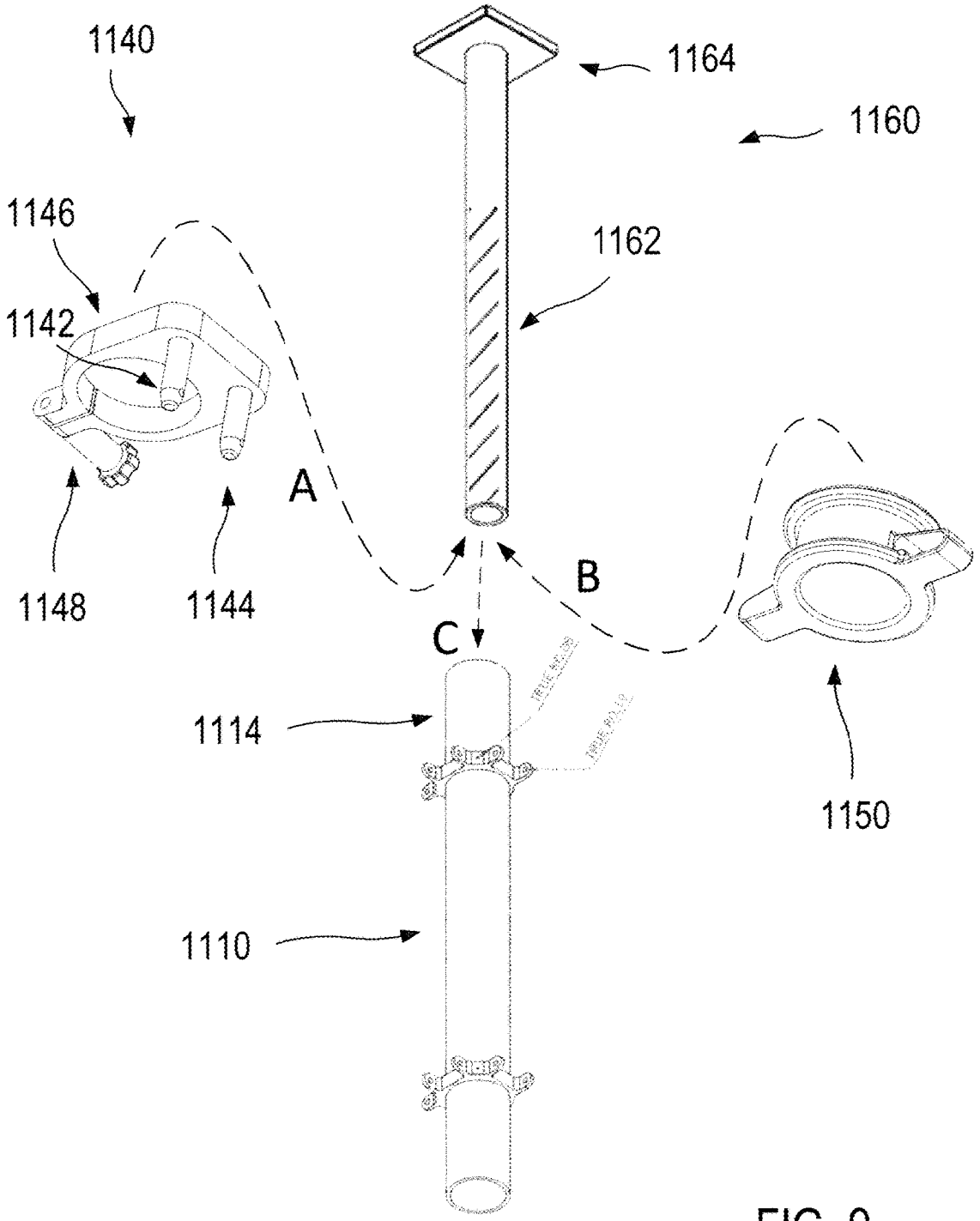
FIG. 9 illustrates components of an exemplary platform assembly, according to certain embodiments of the invention.

FIG. 9 illustrates the assembly of various components of an exemplary platform assembly. According to some embodiments, a platform assembly can further include multiple top units 1160. As shown here, a top unit 1160 includes a threaded post 1162 and a plate 1164. A platform assembly can also include an upper support 1140 and an upper locking nut 1150. As shown here, upper support 1140 includes a first pin 1142, a second pin 1144, a collar 1146 defining an aperture, and an adjustment mechanism 1148 (e.g. threaded bolt to engage a corresponding threaded interior cylinder of the collar). The aperture of collar 1146 of the lower support

1140 is configured to receive the threaded post 1162, as indicated by arrow A. The lower support 1140 can be clamped to the threaded post 1162 by tightening the adjustment mechanism 1148. Upper locking nut 1150 can have a threaded interior section (not shown), which can threadingly engage the threaded post 1162 of the top unit 1160, when locking nut 1150 receives threaded post 1162 as indicated by arrow B. As shown here, upper portion 1114 of upper post 1110 can receive threaded post 1162 of top unit 1160, as indicated by arrow C.

Figure 10:
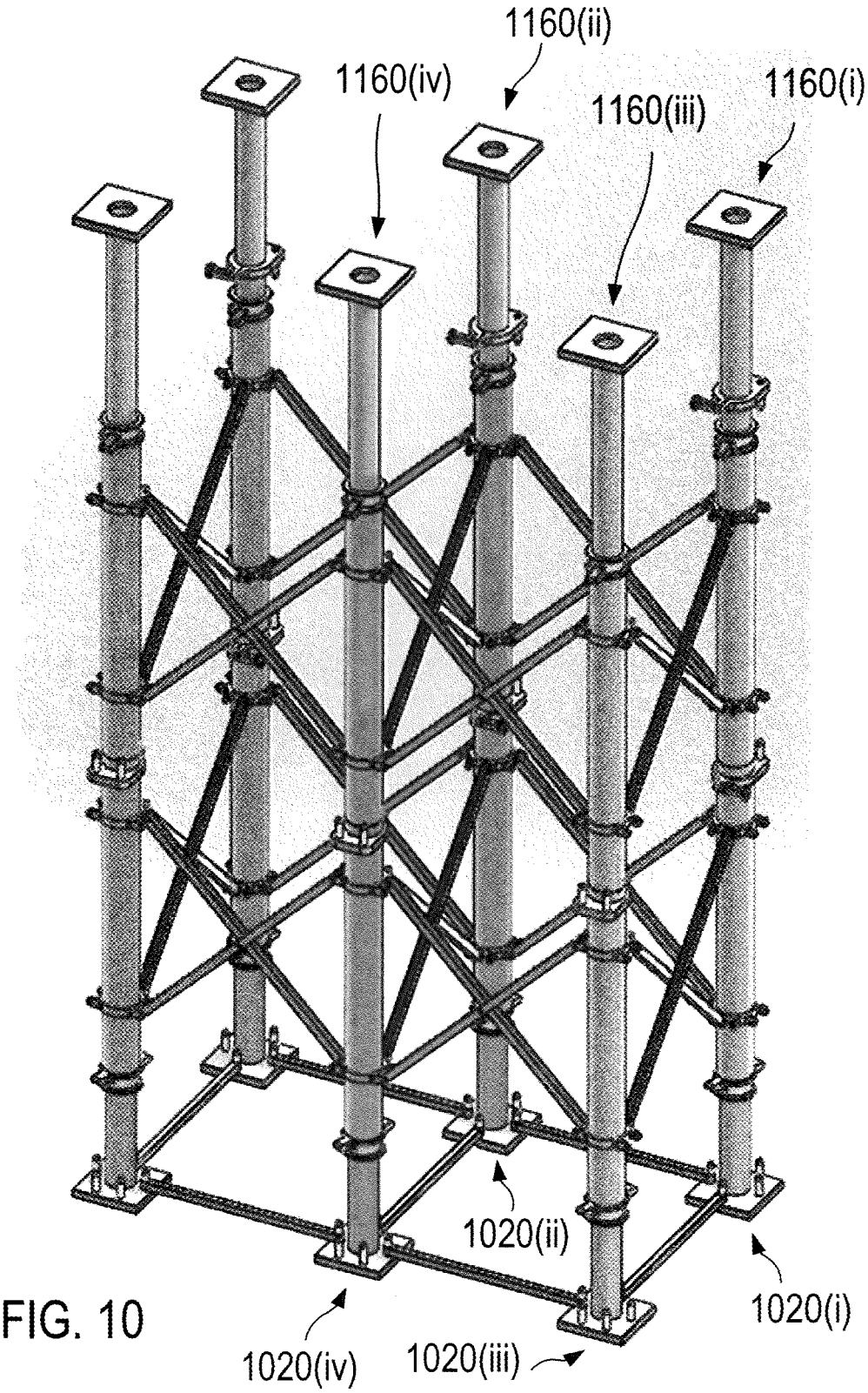
FIG. 10 depicts components of a partially assembled platform assembly, according to certain embodiments of the invention.

FIG. 10 depicts a partially assembled platform assembly. As shown here, the assembly includes a first exterior base unit 1020(*i*) with attached components as further described herein with regard to FIGS. 2-9 (e.g. first exterior top unit 1160(*i*), second exterior top unit 1160(*ii*), first interior top unit 1160(*iii*), and second interior top unit 1160(*iv*), a second exterior base unit 1020(*ii*), a first interior base unit 1020(*ii*), and a second interior base unit 1020(*iv*). As illustrated here, additional base units and corresponding component parts can also be added so as to form an extended platform assembly.

Figure 11:
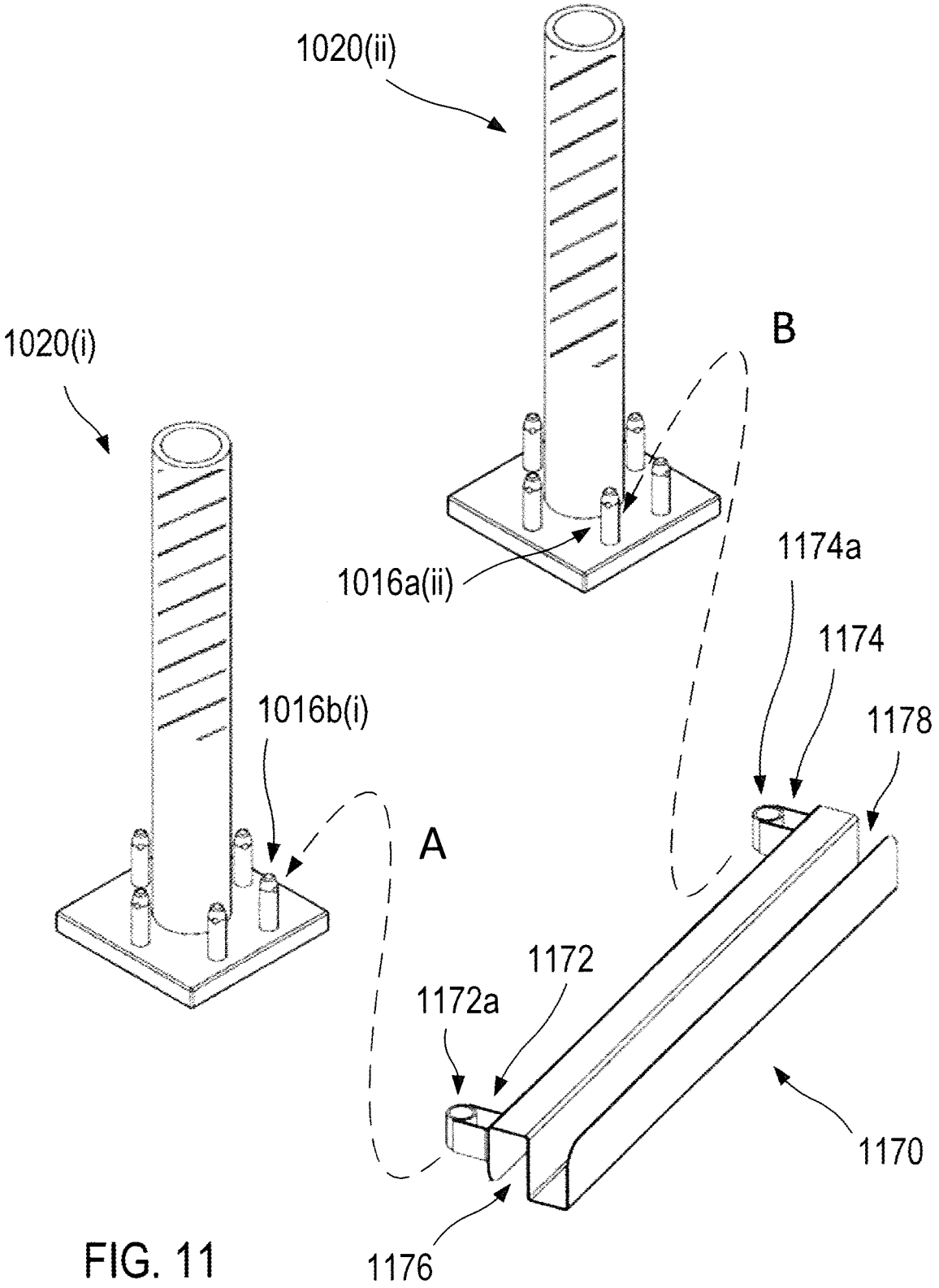
FIG. 11 illustrates components of an exemplary platform assembly, according to certain embodiments of the invention.

FIG. 11 illustrates the assembly of various components of an exemplary platform assembly. According to some embodiments, a platform assembly can further include multiple z-bars 1160. As shown here, a z-bar 1170 (here, a base z-bar) can include a first bracket 1172 having a sleeve 1172*a*, a second bracket 1174 having a sleeve 1174*a*, an interior trough 1176, and an exterior trough 1178. The troughs can operate to hold or support protective or armored panels, as discussed elsewhere herein. The first sleeve 1172 is configured to receive a second exterior pin 1016*b*(i) of a first base unit 1010(*i*) as indicated by arrow A, and the second sleeve 1174 is configured to receive a first exterior pin 1016*a*(ii) of a second base unit 1010(*ii*) as indicated by arrow B.

Figure 12:
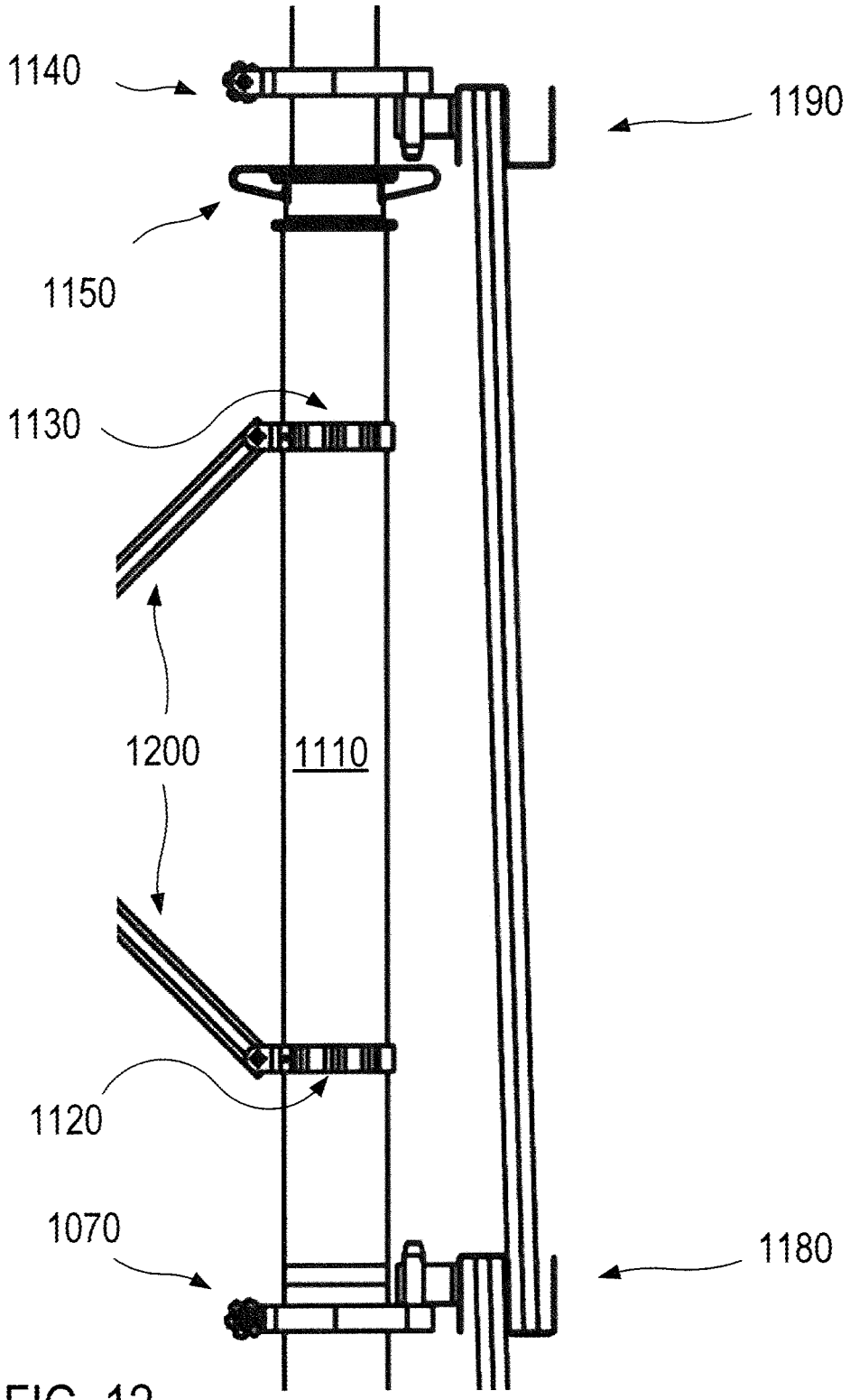
FIG. 12 illustrates components of an exemplary platform assembly, according to certain embodiments of the invention.

FIG. 12 depicts additional aspects of an exemplary platform assembly. As shown here, a lower z-bar 1180 can be coupled with a lower support 1070 and an upper z-bar 1190 can be coupled with an upper support 1140. An interior trough of the lower z-bar holds an upper portion of a lower panel, and an exterior trough of the lower z-bar holds a lower portion of an upper panel. An interior trough of the upper z-bar holds an upper portion of the upper panel. Also shown here are an upper locking nut 1150, an upper cross-member 1200 coupled with first mount 1120 and second mount 1130, and an upper post 1110.

Figure 13B:
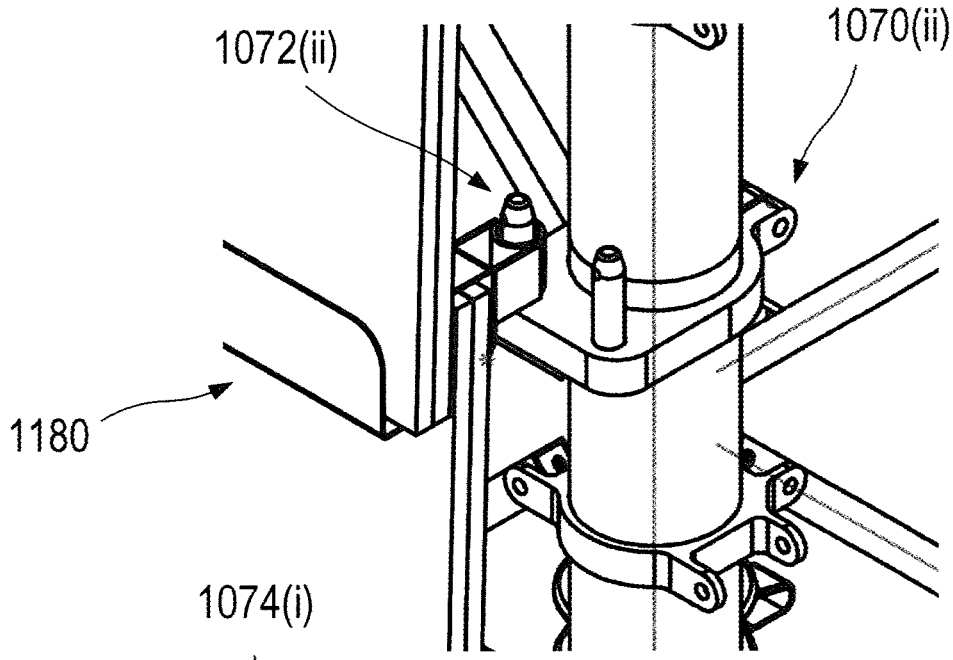
FIGS. 13A and 13B illustrate components of an exemplary platform assembly, according to certain embodiments of the invention.
Figure 13A:
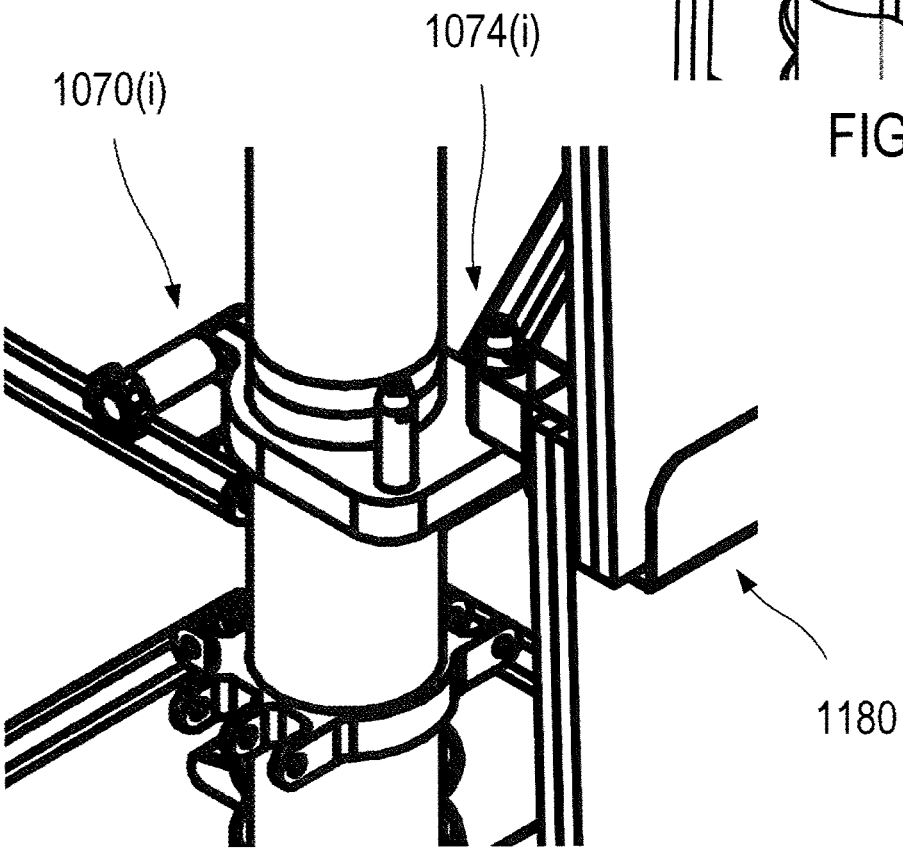

As shown in FIG. 13A, a lower z-bar 1180 can be coupled with a second pin 1074(*i*) of a lower support 1070(*i*) which is positioned above a first exterior base unit (not shown). As shown in FIG. 13B, the opposite end of the same lower z-bar 1180 can be coupled with a first pin 1072(*ii*) of a lower support 1070(*ii*) which is positioned above a second exterior base unit (not shown).

Figure 14B:
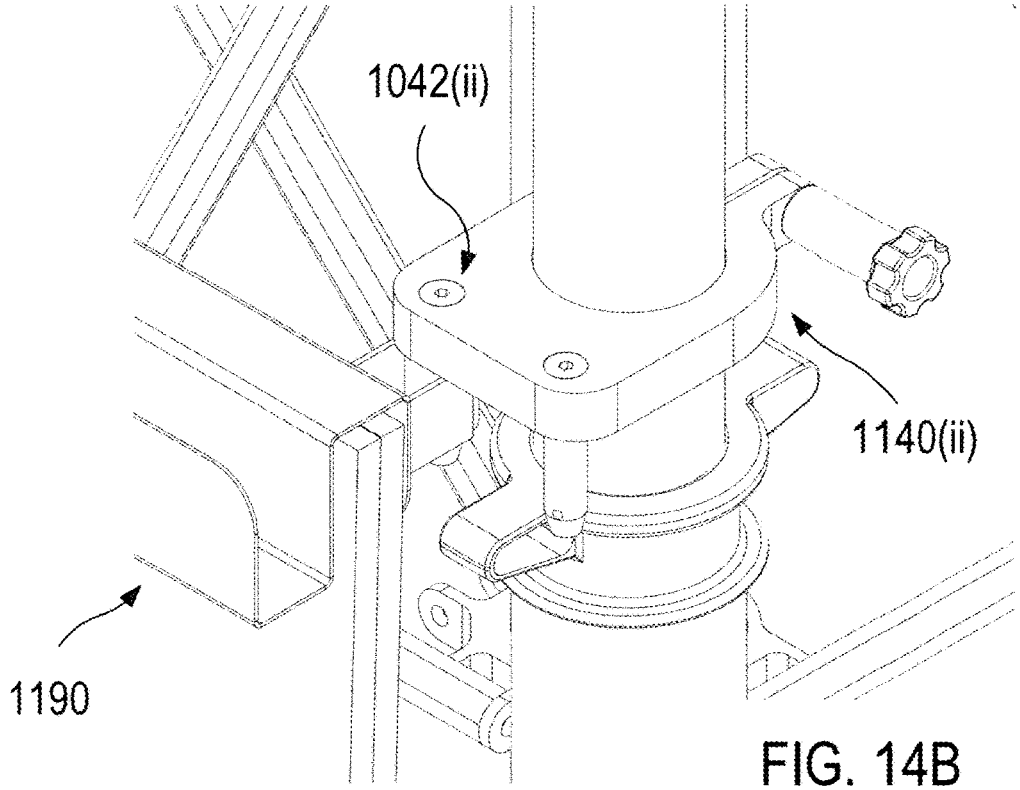
FIGS. 14A and 14B illustrate components of an exemplary platform assembly, according to certain embodiments of the invention.
Figure 14A:
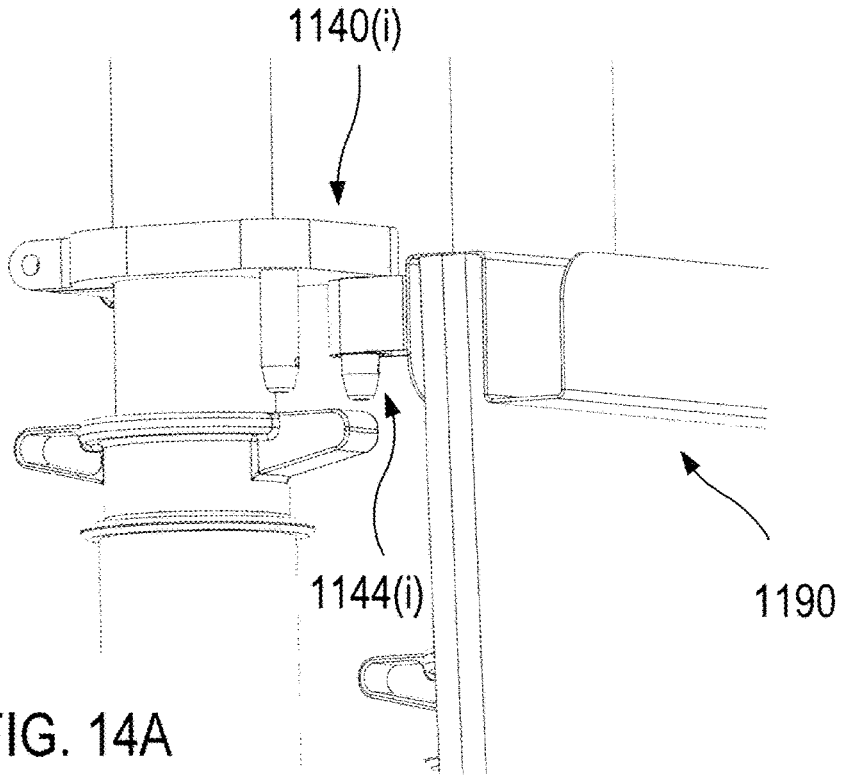

As shown in FIG. 14A, an upper z-bar 1190 can be coupled with a second pin 1144(*i*) of an upper support 1140(*i*) which is positioned above a first exterior base unit (not shown). As shown in FIG. 14B, the opposite end of the same upper z-bar 1190 can be coupled with a first pin 1042(*ii*) of an upper support 1140(*ii*) which is positioned above a second exterior base unit (not shown).

Figure 15:
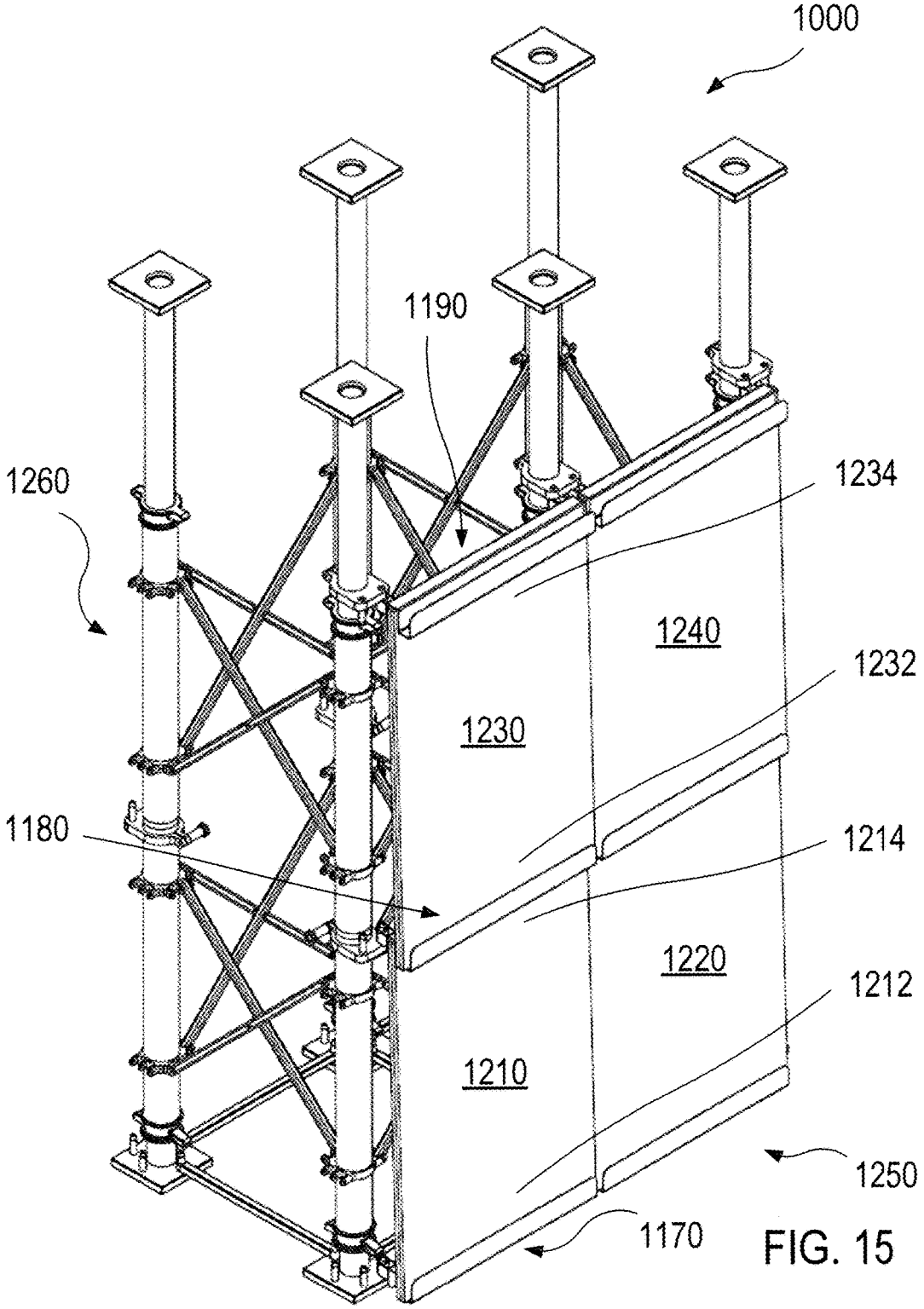
FIG. 15 depicts components of an assembled platform assembly, according to certain embodiments of the invention.

FIG. 15 depicts aspects of a fully constructed platform assembly 1000, according to embodiments of the present invention. As shown here, the platform assembly 1000 includes a first lower panel 1210, a second lower panel 1220, a first upper panel 1230, and a second upper panel 1240. The z-bars operate to hold the panels in place. For example, a lower portion 1212 of lower panel 1210 is received by an exterior trough of base z-bar 1170 and an upper portion 1214 of lower panel is received by an interior trough of lower z-bar 1180. Similarly, a lower portion 1232 of upper panel 1230 is received by an exterior trough of lower z-bar 1180, and an upper portion 1234 of upper panel 1230 is received by an interior trough of upper z-bar 1190. In the embodiment shown here, panels are installed only on the exterior side 1250 of the platform assembly 1000, which faces toward the interior of the room (e.g. as depicted in FIG. 1). The instant disclosure also encompasses embodiments that include z-bars and panels installed on the interior side of the platform assembly, which faces toward the building wall. For example, if the building wall has a window, it may be desirable to have additional panel protection on the interior side 1260 the platform, adjacent to the window. As shown here, the panels can be oriented at an angle or tilt, due to their engagement with the troughs of the z-bars. Such panel tilt can have an advantageous effect on performance, by assisting with the ballistic protection and deflecting projectiles by introducing an angle to trajectory of the fragments or bullets, and thereby enhancing the diversion of the fragments or bullets.

Figure 17:
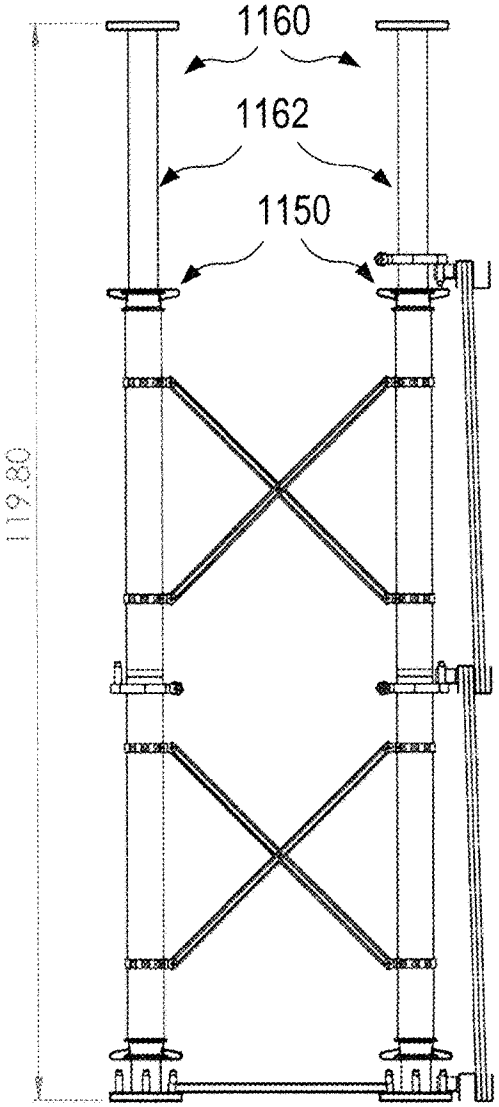
FIG. 17 depicts aspects of an assembled platform assembly in an extended height configuration, according to certain embodiments of the invention.
Figure 16:
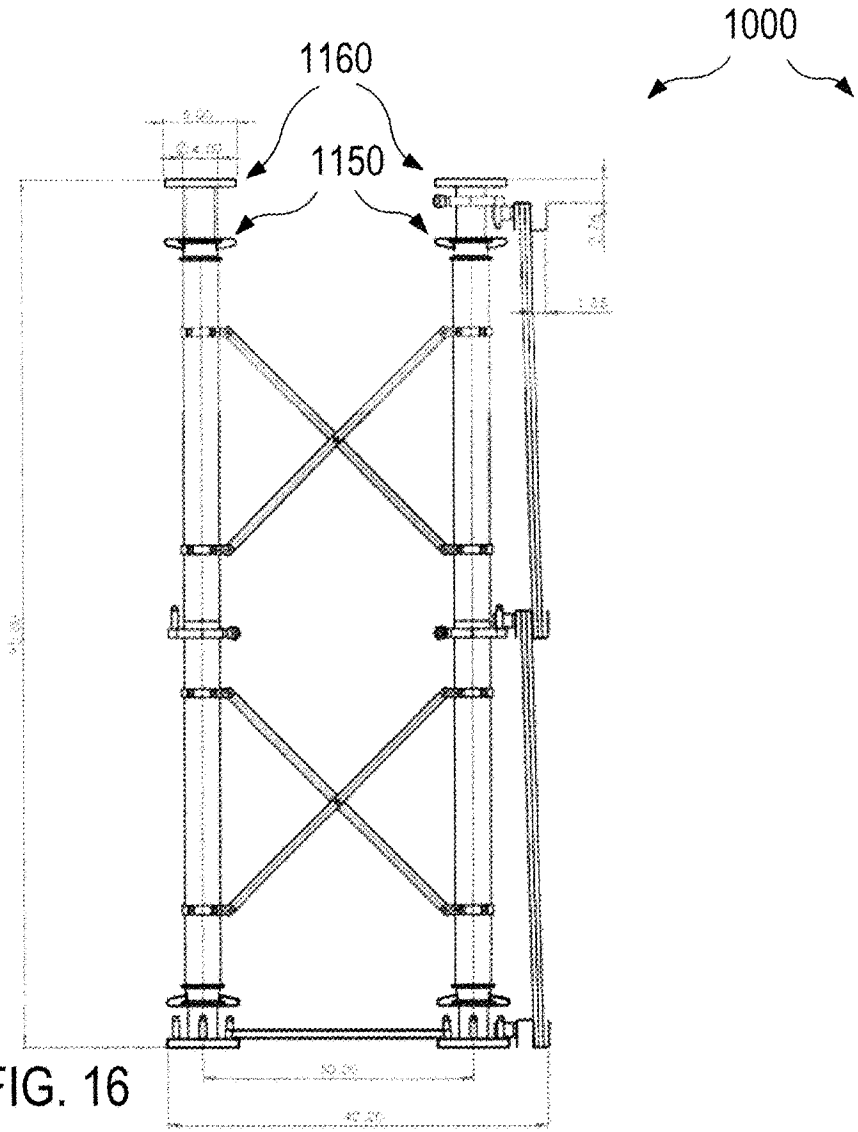
FIG. 16 depicts aspects of an assembled platform assembly in a retracted height configuration, according to certain embodiments of the invention.

As shown in FIGS. 16 and 17, the height of a platform assembly 1000 can be adjusted as desired, by adjusting the positions of individual upper locking nuts 1150 along the length of the threaded posts 1162 of the top units 1160. In some cases, the height can be extended to up to 10.5'. The system can be extended up to 14' or more if additional pieces are used (e.g. by incorporating additional levels of intermediate and/or upper posts).

Figure 18:
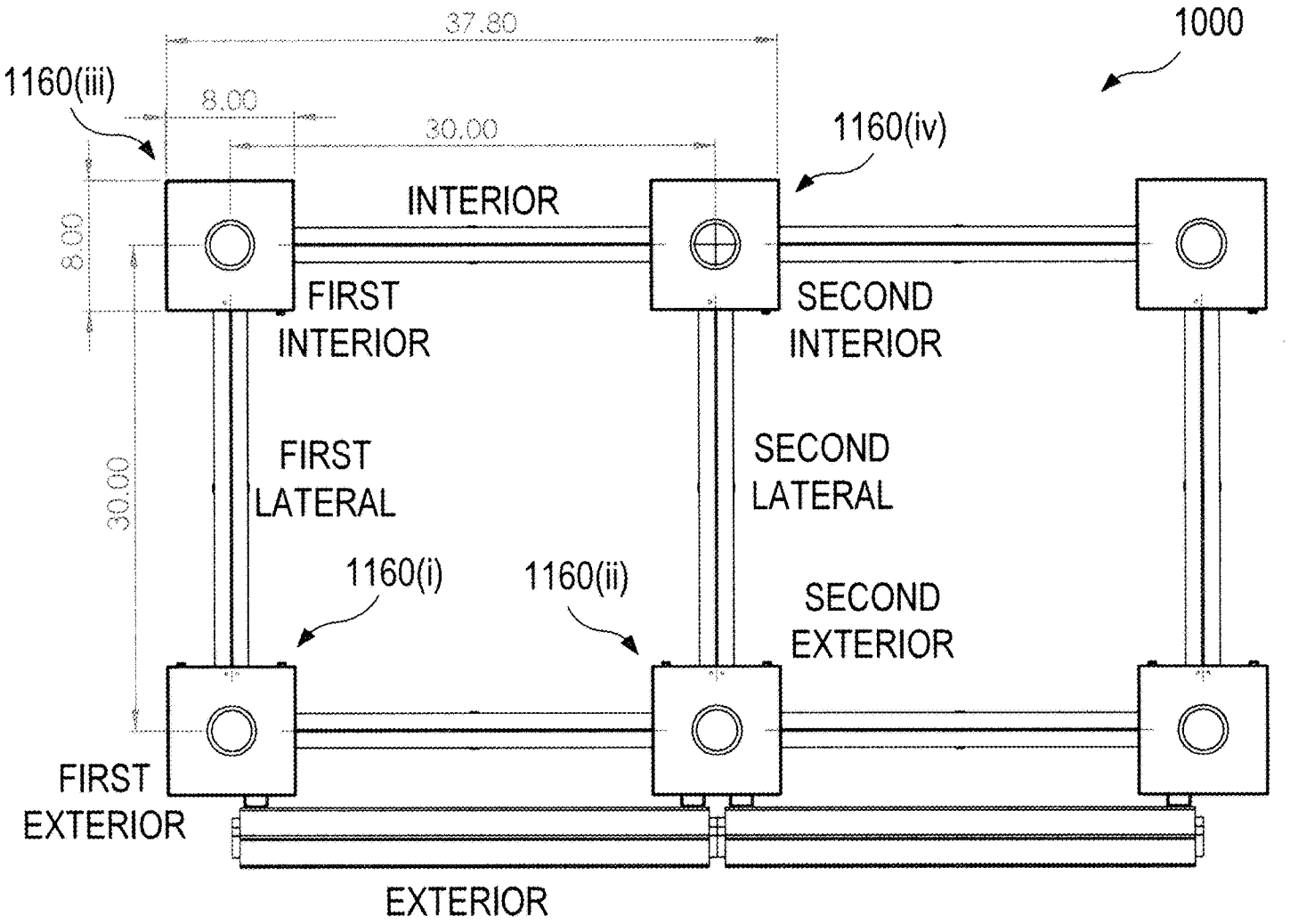
FIG. 18 provides a top plan view of a platform assembly, according to certain embodiments of the invention.

FIG. 18 depicts a top plan view of a platform assembly 1000 according to embodiments of the present invention, and is provided to illustrate certain aspects of the labeling conventions used in the instant disclosure. For example, the top units can be referred to as a first exterior top unit 1160(*i*), a second exterior top unit 1160(*ii*), a first interior top unit 1160(*iii*), and a second interior top unit 1160(*iv*).

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A platform assembly for installation near an interior wall surface of a building, the platform assembly comprising:

a first exterior base unit comprising a threaded post, a plate, an exterior pin, and a lateral pin;

a second exterior base unit comprising a threaded post, a plate, an exterior pin, and a lateral pin;

an exterior stability bar comprising a first sleeve configured to slidingly engage the lateral pin of the first exterior base unit and a second sleeve configured to slidingly engage the lateral pin of the second exterior base unit;

a first lower exterior locking nut configured to threadingly engage the threaded post of the first exterior base unit;

a second lower exterior locking nut configured to threadingly engage the threaded post of the second exterior base unit;

a first exterior intermediate post comprising an upper portion and a lower portion;

a second exterior intermediate post comprising an upper portion and a lower portion;

a first lower exterior support comprising a pin and a collar configured to receive the upper portion of the first exterior intermediate post;

a second lower exterior support comprising a pin and a collar configured to receive the upper portion of the second exterior intermediate post;

a first exterior connector post having an upper portion and a lower portion, wherein the lower portion is configured to be received by the upper portion of the first exterior intermediate post;

a second exterior connector post having an upper portion and a lower portion, wherein the lower portion is configured to be received by the upper portion of the second exterior intermediate post;

a first exterior upper post comprising an upper portion and a lower portion configured to receive the upper portion of the first exterior connector post;

a second exterior upper post comprising an upper portion and a lower portion configured to receive the upper portion of the second exterior connector post;

a first exterior top unit comprising a threaded post and a plate;

a second exterior top unit comprising a threaded post and a plate;

a first upper exterior support comprising a pin and a collar configured to receive the threaded post of the first exterior top unit;

a second upper exterior support comprising a pin and a collar configured to receive the threaded post of the second exterior top unit;

a first upper exterior locking nut configured to threadingly engage the threaded post of the first exterior top unit;

a second upper exterior locking nut configured to threadingly engage the threaded post of the second exterior top unit;

a base z-bar comprising an interior trough, an exterior trough, a first sleeve configured to receive the exterior pin of the first exterior base unit, and a second sleeve configured to receive the exterior pin of the second exterior base unit;

a lower z-bar comprising an interior trough, an exterior trough, a first sleeve configured to receive the pin of the first lower exterior support, and a second sleeve configured to receive the pin of the second lower exterior support;

an upper z-bar comprising an interior trough, an exterior trough, a first sleeve configured to receive the pin of the first upper exterior support, and a second sleeve configured to receive the pin of the second upper exterior support;

a lower panel having a lower portion and an upper portion, wherein the lower portion is received by the exterior trough of the base z-bar and the upper portion is received by the interior trough of the lower z-bar; and an upper panel having a lower portion and an upper portion, wherein the lower portion is received by the exterior trough of the lower z-bar and the upper portion is received by the interior trough of the upper z-bar.

2. The platform assembly of claim 1, further comprising an exterior lower cross-member, wherein the first exterior intermediate post includes an upper mount and a lower mount, wherein the second exterior intermediate post includes an upper mount and a lower mount, and wherein the exterior lower cross-member is coupled with the upper and lower mounts of the first exterior intermediate post and with the upper and lower mounts of the second exterior intermediate post.

3. The platform assembly of claim 1, further comprising an exterior upper cross-member, wherein the first exterior upper post includes an upper mount and a lower mount, wherein the second exterior upper post includes an upper mount and a lower mount, and wherein the exterior upper cross-member is coupled with the upper and lower mounts of the first exterior upper post and with the upper and lower mounts of the second exterior upper post.

4. The platform assembly of claim 1, further comprising an exterior lower cross-member and an exterior upper cross-member, wherein the first exterior intermediate post includes an upper mount and a lower mount, wherein the second exterior intermediate post includes an upper mount and a lower mount, wherein the exterior lower cross-member is coupled with the upper and lower mounts of the first exterior intermediate post and with the upper and lower mounts of the second exterior intermediate post, wherein the first exterior upper post includes an upper mount and a lower mount, wherein the second exterior upper post includes an upper mount and a lower mount, and wherein the exterior upper cross-member is coupled with the upper and lower mounts of the first exterior upper post and with the upper and lower mounts of the second exterior upper post.

5. The platform assembly of claim 1, wherein rotation of the first upper exterior locking nut operates to either extend or retract the first exterior top unit, and rotation of the second upper exterior locking nut operates to either extend or retract the second exterior top unit.

6. The platform assembly of claim 1, wherein the lower panel and the upper panel are each oriented at a tilt.

7. A platform assembly for installation near an interior wall surface of a building, the platform assembly comprising:

a first exterior base unit comprising a threaded post, a plate, a first exterior pin, a second exterior pin, a first lateral pin, a second lateral pin, and an interior pin;

a second exterior base unit comprising a threaded post, a plate, a first exterior pin, a second exterior pin, a first lateral pin, a second lateral pin, and an interior pin;

a first interior base unit comprising a threaded post, a plate, a first exterior pin, a second exterior pin, a first lateral pin, a second lateral pin, and an interior pin;

a second interior base unit comprising a threaded post, a plate, a first exterior pin, a second exterior pin, a first lateral pin, a second lateral pin, and an interior pin;

an exterior stability bar comprising a first sleeve configured to slidingly engage the second lateral pin of the first exterior base unit and a second sleeve configured to slidingly engage the first lateral pin of the second exterior base unit;

a first lateral stability bar comprising a first sleeve configured to slidingly engage the interior pin of the first exterior base unit and a second sleeve configured to slidingly engage the interior pin of the first interior base unit;

a second lateral stability bar comprising a first sleeve configured to slidingly engage the interior pin of the second exterior base unit and a second sleeve configured to slidingly engage the interior pin of the second interior base unit;

an interior stability bar comprising a first sleeve configured to slidingly engage the second lateral pin of the first interior base unit and a second sleeve configured to slidingly engage the first lateral pin of the second interior base unit;

a first lower exterior locking nut having a threaded aperture configured to threadingly engage the threaded post of the first exterior base unit;

a second lower exterior locking nut having a threaded aperture configured to threadingly engage the threaded post of the second exterior base unit;

a first lower interior locking nut having a threaded aperture configured to threadingly engage the threaded post of the first interior base unit;

a second lower interior locking nut having a threaded aperture configured to threadingly engage the threaded post of the second interior base unit;

a first exterior intermediate post comprising an upper portion, a lower portion, a lower mount, and an upper mount;

a second exterior intermediate post comprising an upper portion, a lower portion, a lower mount, and an upper mount;

a first interior intermediate post comprising an upper portion, a lower portion, a lower mount, and an upper mount;

a second interior intermediate post comprising an upper portion, a lower portion, a lower mount, and an upper mount;

a first lower exterior support comprising a first pin, a second pin, a collar having an aperture configured to receive the upper portion of the first exterior intermediate post, and an adjustment mechanism;

a second lower exterior support comprising a first pin, a second pin, a collar having an aperture configured to receive the upper portion of the second exterior intermediate post, and an adjustment mechanism;

a first lower interior support comprising a first pin, a second pin, a collar having an aperture configured to receive the upper portion of the first interior intermediate post, and an adjustment mechanism;

a second lower interior support comprising a first pin, a second pin, a collar having an aperture configured to receive the upper portion of the second interior intermediate post, and an adjustment mechanism;

a first exterior connector post having an upper portion and a lower portion, wherein the lower portion is configured to be received by the upper portion of the first exterior intermediate post;

a second exterior connector post having an upper portion and a lower portion, wherein the lower portion is configured to be received by the upper portion of the second exterior intermediate post;

a first interior connector post having an upper portion and a lower portion, wherein the lower portion is configured to be received by the upper portion of the first interior intermediate post;

a second interior connector post having an upper portion and a lower portion, wherein the lower portion is configured to be received by the upper portion of the second interior intermediate post;

a first exterior upper post comprising an upper portion, a lower portion configured to receive the upper portion of the first exterior connector post, a lower mount, and an uppermount;

a second exterior upper post comprising an upper portion, a lower portion configured to receive the upper portion of the second exterior connector post, a lower mount, and an upper mount;

a first interior upper post comprising an upper portion, a lower portion configured to receive the upper portion of the first interior connector post, a lower mount, and an uppermount;

a second interior upper post comprising an upper portion, a lower portion configured to receive the upper portion of the second interior connector post, a lower mount, and an upper mount;

a first exterior top unit comprising a threaded post and a plate;

a second exterior top unit comprising a threaded post and a plate;

a first interior top unit comprising a threaded post and a plate;

a second interior top unit comprising a threaded post and a plate;

a first upper exterior support comprising a first pin, a second pin, a collar having an aperture configured to receive the threaded post of the first exterior top unit, and an adjustment mechanism;

a second upper exterior support comprising a first pin, a second pin, a collar having an aperture configured to receive the threaded post of the second exterior top unit, and an adjustment mechanism;

a first upper interior support comprising a first pin, a second pin, a collar having an aperture configured to receive the threaded post of the first interior top unit, and an adjustment mechanism;

a second upper interior support comprising a first pin, a second pin, a collar having an aperture configured to receive the threaded post of the second interior top unit, and an adjustment mechanism;

a first upper exterior locking nut having a threaded aperture configured to threadingly engage the threaded post of the first exterior top unit;

a second upper exterior locking nut having a threaded aperture configured to threadingly engage the threaded post of the second exterior top unit;

a first upper interior locking nut having a threaded aperture configured to threadingly engage the threaded post of the first interior top unit;

a second upper interior locking nut having a threaded aperture configured to threadingly engage the threaded post of the second interior top unit;

a first upper exterior support comprising a first pin, a second pin, a collar having an aperture configured to receive the upper portion of the first exterior intermediate post, and an adjustment mechanism;

a second upper exterior support comprising a first pin, a second pin, a collar having an aperture configured to receive the upper portion of the second exterior intermediate post, and an adjustment mechanism;

a first upper interior support comprising a first pin, a second pin, a collar having an aperture configured to receive the upper portion of the first interior intermediate post, and an adjustment mechanism;

a second upper interior support comprising a first pin, a second pin, a collar having an aperture configured to receive the upper portion of the second interior intermediate post, and an adjustment mechanism;

a base z-bar comprising an interior trough, an exterior trough, a first bracket having a first sleeve, and a second bracket having a second sleeve, wherein the first sleeve is configured to receive the second exterior pin of the first exterior base unit and the second sleeve is configured to receive the first exterior pin of the second exterior base unit;

a lower z-bar comprising an interior trough, an exterior trough, a first bracket having a first sleeve, and a second bracket having a second sleeve, wherein the first sleeve is configured to receive the second pin of the first lower exterior support and the second sleeve is configured to receive the first pin of the second lower exterior support;

an upper z-bar comprising an interior trough, an exterior trough, a first bracket having a first sleeve, and a second bracket having a second sleeve, wherein the first sleeve is configured to receive the second pin of the first upper exterior support and the second sleeve is configured to receive the first pin of the second upper exterior support;

a lower panel having a lower portion and an upper portion, wherein the lower portion is received by the exterior trough of the base z-bar and the upper portion is received by the interior trough of the lower z-bar;

an upper panel having a lower portion and an upper portion, wherein the lower portion is received by the exterior trough of the lower z-bar and the upper portion is received by the interior trough of the upper z-bar;

a lower exterior cross-member coupled with the lower and upper mounts of the first and second exterior intermediate posts;

an upper exterior cross-member coupled with the lower and upper mounts of the first and second exterior upper posts;

a lower first lateral cross-member coupled with the lower and upper mounts of the first exterior intermediate post and the lower and upper mounts of the first interior intermediate post;

an upper first lateral cross-member coupled with the lower and upper mounts of the first exterior upper post and the lower and upper mounts of the first interior upper post;

a lower second lateral cross-member coupled with the lower and upper mounts of the second exterior intermediate post and the lower and upper mounts of the second interior intermediate post;

an upper second lateral upper lateral cross-member coupled with the lower and upper mounts of the second exterior upper post and the lower and upper mounts of the second interior upper post;

a lower interior cross-member coupled with the lower and upper mounts of the first and second interior intermediate posts; and an upper interior cross-member coupled with the lower and upper mounts of the first and second interior upper posts.

* * * * *